US012571596B2

(12) United States Patent
Jiang et al.

(10) Patent No.: US 12,571,596 B2
(45) Date of Patent: Mar. 10, 2026

(54) HEAT EXCHANGER

(71) Applicant: ZHEJIANG SANHUA AUTOMOTIVE COMPONENTS CO., LTD., Zhejiang (CN)

(72) Inventors: Weixin Jiang, Zhejiang (CN); Fangfang Yin, Zhejiang (CN)

(73) Assignee: ZHEJIANG SANHUA AUTOMOTIVE COMPONENTS CO., LTD., Hangzhou (CN)

( * ) Notice: Subject to any disclaimer, the term of this patent is extended or adjusted under 35 U.S.C. 154(b) by 209 days.

(21) Appl. No.: 18/270,473

(22) PCT Filed: Dec. 31, 2021

(86) PCT No.: PCT/CN2021/143447
§ 371 (c)(1),
(2) Date: Jun. 29, 2023

(87) PCT Pub. No.: WO2022/143966
PCT Pub. Date: Jul. 7, 2022

(65) Prior Publication Data

US 2024/0068752 A1 Feb. 29, 2024

(30) Foreign Application Priority Data

Dec. 31, 2020 (CN) ..... 202011623897.5

(51) Int. Cl.
*F28D 9/00* (2006.01)

(52) U.S. Cl.
CPC ..... *F28D 9/0031* (2013.01); *F28D 9/0037* (2013.01); *F28D 9/005* (2013.01); *F28D 9/0056* (2013.01)

(58) Field of Classification Search
CPC ..... F28D 9/0056; F28D 9/0037; F28D 9/005; F28D 9/0031
See application file for complete search history.

(56) References Cited

U.S. PATENT DOCUMENTS

2004/0040697 A1 3/2004 Pierre
2006/0081358 A1* 4/2006 Pierre ..... F28D 9/0012 165/81

(Continued)

FOREIGN PATENT DOCUMENTS

CN 1650141 A 8/2005
CN 101069059 A 11/2007

(Continued)

OTHER PUBLICATIONS

Translation of KR20110039977A named TRANSLATION-KR20110039977A (Year: 2011).*

(Continued)

*Primary Examiner* — Paul Alvare
(74) *Attorney, Agent, or Firm* — Yue (Robert) Xu; Apex Attorneys at Law, LLP

(57) ABSTRACT

A heat exchanger including a core is provided. The core includes a first plate and a second plate; the core is provided with a first fluid channel including a first inter-plate channel and a second fluid channel including a second inter-plate channel; the core has a first separation portion located on the first plate and a second separation portion; the first separation portion is provided with a first welding portion, a second welding portion, and a first main body portion; the first welding portion has a first welding surface, and the first welding surface is welded and fixed to an adjacent second plate on one side of the first plate; and the second welding portion has a second welding surface, and the second welding surface is welded and fixed to an adjacent second plate on the other side of the first plate.

7 Claims, 5 Drawing Sheets

(56) References Cited

U.S. PATENT DOCUMENTS

| | | | | |
|---|---|---|---|---|
| 2010/0258285 | A1* | 10/2010 | Yao | F28F 3/046 165/167 |
| 2011/0108258 | A1 | 5/2011 | Magnier-Cathenod et al. | |
| 2013/0126149 | A1* | 5/2013 | Kim | F28D 9/0093 165/300 |
| 2015/0000869 | A1* | 1/2015 | Denoual | F28F 3/08 165/96 |
| 2015/0233650 | A1* | 8/2015 | Blomgren | F28F 3/06 165/166 |
| 2016/0356205 | A1* | 12/2016 | Braun | F02M 35/10268 |
| 2018/0292142 | A1* | 10/2018 | Schouten | F28D 9/0043 |
| 2019/0219313 | A1* | 7/2019 | Draenkow | F28D 9/0056 |
| 2020/0006822 | A1* | 1/2020 | Shisler | F28D 9/005 |
| 2021/0262735 | A1* | 8/2021 | Yin | F28D 9/0056 |

FOREIGN PATENT DOCUMENTS

| | | | | |
|---|---|---|---|---|
| CN | 102084205 | A | | 6/2011 |
| CN | 103424024 | A | | 12/2013 |
| CN | 205079654 | U | | 3/2016 |
| IN | 110657692 | A | | 1/2020 |
| KR | 20110039977 | A | * | 4/2011 |
| TW | 201013151 | A | | 4/2010 |
| WO | 2006042405 | A1 | | 4/2006 |

OTHER PUBLICATIONS

European search report issued on Oct. 25, 2024 for EP21914695.8.
International Search Report for PCT/CN2021/143447 mailed Mar. 28, 2022, ISA/CN.

* cited by examiner

HEAT EXCHANGER

This application is the national phase of International Application No. PCT/CN2021/143447, titled "HEAT EXCHANGER", filed on Dec. 31, 2021, which claims the benefit of the priority to Chinese Patent Application No. 202011623897.5, titled "HEAT EXCHANGER", filed with the China National Intellectual Property Administration on Dec. 31, 2020, the entire disclosures thereof are incorporated herein by reference.

FIELD

The present application relates to the technical field of heat exchange, and in particular to a heat exchanger.

BACKGROUND

A plate heat exchanger has high heat exchange efficiency, compact structure and relatively light weight, which can be used in many industries such as refrigeration, chemical industry and water treatment. The basic principle of the plate heat exchanger is that two heat exchange mediums exchange heat through heat exchange plates in adjacent flow passages. With the increase of the application scenarios of the plate heat exchanger, the performance requirements for the plate heat exchanger are also improved. In a heat exchanger with a U-shaped inter-plate passage, although the inter-plate passage is long, the structures of the middle blocking portions of the plates are provided in a nested and stacked manner, which requires high matching accuracy between the plates.

SUMMARY

An object according to the present application is to provide a heat exchanger with an isolation portion which is easy in installation and convenient in manufacture.

A heat exchanger according to an embodiment of the present application includes a core, the core includes first plates and second plates are stacked, the core is provided with a first fluid passage and a second fluid passage which are isolated from each other, where the core is provided with first isolation portions and second isolation portions, each first isolation portion is located on a corresponding first plate, and each second isolation portion is located on a corresponding second plate; the first isolation portion has a first welding portion, a second welding portion and a first main body portion; the first main body portion is located between the first welding portion and the second welding portion; the first welding portion has a first welding surface, the first welding surface faces an adjacent second plate, located at one side of the first plate, of the second plates, and the first welding surface is fixed to the second isolation portion of the adjacent second plate located at the one side of the first plate by welding; the second welding portion has a second welding surface, the second welding surface faces another adjacent second plate, located at another side of the first plate, of the second plates, and the second welding surface is fixed to the second isolation portion of the another adjacent second plate located at the another side of the first plate by welding.

The heat exchanger according to the embodiment of the present application includes the first plates, each of the first plate includes the first isolation portion, the first isolation portion has the first welding portion and the second welding portion, the first welding portion has the first welding surface, the first welding surface is welded to the second isolation portion of the second plate located at the one side of the first plate by welding, the second welding portion has the second welding surface, and the second welding surface is fixed to the second isolation portion of the second plate located at the another side of the first plate by welding. In this way, matching requirements of the isolation portions can be lowered, which facilitates mounting and processing.

REFERENCE NUMERALS

Figure 1:
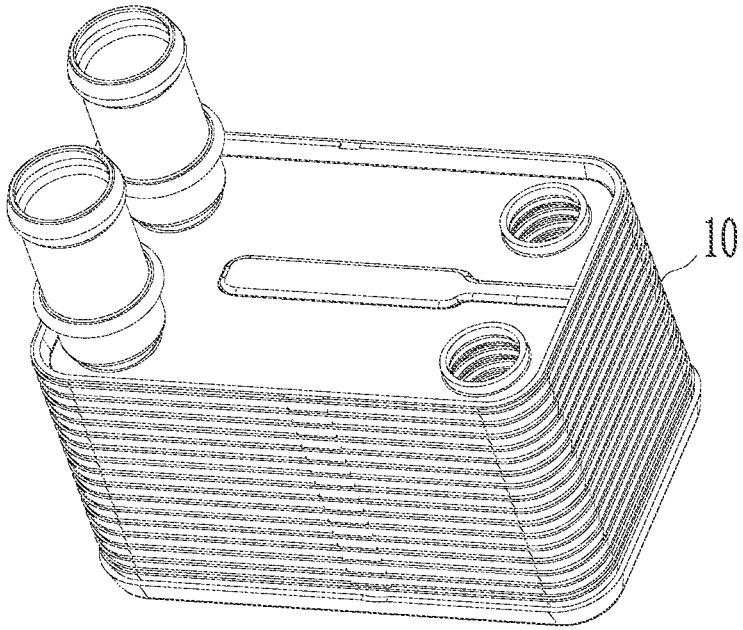
FIG. 1 is a schematic perspective view showing the structure of a heat exchanger according to an embodiment of the present application.

| | | | |
|---|---|---|---|
| 10 | core, | 1 | first plate, |
| 11 | first middle portion, | 12 | first flange, |
| 13 | first isolation portion, | 131 | first welding portion, |
| 1311 | first welding surface, | 132 | second welding portion, |
| 1321 | second welding surface, | 133 | first main body portion, |
| 134 | fourth welding portion, | 1341 | fourth welding surface, |
| 135 | fourth main body portion, | 136 | fifth main body portion, |
| 137 | fifth welding portion, | 1371 | sixth welding surface, |
| 14 | fourth isolation portion, | 141 | eighth welding surface, |
| 2 | second plate, | 21 | second middle portion, |
| 22 | second flange, | 23 | second isolation portion, |
| 231 | third welding portion, | 2311 | third welding surface, |
| 2312 | fifth welding surface, | 232 | second main body portion, |
| 233 | third main body portion, | 24 | third isolation portion, |
| 2411 | seventh welding surface. | | |

DETAILED DESCRIPTION OF THE EMBODIMENTS

For those skilled in the art to better understand the technical solutions of the present application, the present application is further described hereinafter with reference to the drawings and specific embodiments.

In this specification, the terms "up, down, left, right" are based on the positional relationship shown in the attached drawings, and the corresponding positional relationship may be different in different attached drawings. Therefore, those terms should not be construed as an absolute limitation of the scope of protection. Moreover, the relationship terminologies such as "first", "second", and the like are only used herein to distinguish one element from another having the same name, which does not require or imply that the actual relationship or order exists between the elements. The word "communication" refers to direct communication or indirection communication through other passage.

Referring to FIG. 1 to FIG. 6, a heat exchanger includes a core 10, where the core 10 includes first plates 1 and second plates 2 arranged in a stacking manner. Each first plate includes a first middle portion 11 and a first flange 12 located at a periphery of the first middle portion 11. The first middle portion 11 is substantially rectangular, and corner holes are provided at positions of the first middle portion 11 proximate to corners of the first middle portion. Each second plate 2 includes a second middle portion 21 and a second flange 22 located at a periphery of the second middle portion 21. The second middle portion 21 is substantially rectangular, and corner holes are provided at positions of the second middle portion 21 proximate to corners of the second middle portion. The first plates 1 and the second plates 2 are stacked alternately, and the first flange 12 is welded to the second flange 22 to form the core 10. The corner holes located at one width direction side of the first middle portion 11 align with the corner holes located at one width direction side of the second middle portion 21 to form a first hole passage and a second hole passage, and the corner holes on the other width direction side of the first middle portion 11 align with the corner holes on the other width direction side of the second middle portion 21 to form a third hole passage and a fourth hole passage.

Figure 6:
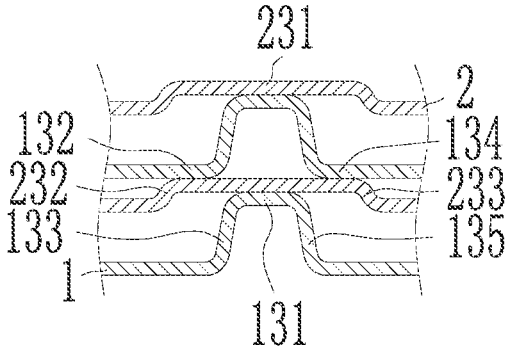
FIG. 6 is a partially cross-sectional schematic view of the heat exchanger according to the embodiment of the present application.

Referring to FIG. 1 and FIG. 6, the core 10 has a first fluid passage and a second fluid passage which are isolated from each other, the first fluid passage includes the first hole passage and the second hole passage which are both located at the one width direction side of the core 10. The first fluid passage further includes first inter-plate passages each located between the first plate 1 and the corresponding second plate 2, and the first hole passage and the second hole passage are in communication with each other through the first inter-plate passages. The second fluid passage includes the third hole passage and the fourth hole passage which are both located at the other width direction side of the core 10. The second fluid passage further includes second inter-plate passages located between the second plate 2 and the first plate 1, and the fourth hole passage and the fourth hole passage are in communication with each other through the second inter-plate passages.

Referring to FIG. 1 to FIG. 6, the core 10 includes first isolation portions 13 and second isolation portions 23, each of the first isolation portions 13 is located on the corresponding first plate. The first isolation portion 13 has a first welding portion 131, a second welding portion 132 and a first main body portion 133, and the first main body portion 133 is located between the first welding portion 131 and the second welding portion 132. The first welding portion 131 has a first welding surface 1311, the first welding surface 1311 faces the second plate 2 located at one side of the first plate 1, and the first welding surface 1311 is fixed to the second isolation portion 23 of the adjacent second plate 2 located at the one side of the first plate 1 by welding, so that the first isolation portion 13 separates the first inter-plate passage into a first inter-plate sub-passage and a second inter-plate sub-passage. The second welding portion 132 has a second welding surface 1321, the second welding surface 1321 faces another adjacent second plate 2 located at another side of the first plate 1, and the second welding surface 1321 is fixed to the second isolation portion 23 of the another adjacent second plate 2 located at the another side of the first plate 1 by welding, so that the second isolation portion 23 separates the second inter-plate passage into a third inter-plate sub-passage and a fourth inter-plate sub-passage.

The heat exchanger includes the first plates 1, the first plate 1 includes the first isolation portion 13, and the first isolation portion 13 has the first welding portion 131 and the second welding portion 132. The first welding portion 131 has the first welding surface 1311, and the first welding surface 1311 is fixed to the second isolation portion 23 of the adjacent second plate 2 located at the one side of the first plate 1 by welding, so that the first isolation portion 13 separates the first inter-plate passage into the first inter-plate sub-passage and the second inter-plate sub-passage. The second welding portion 132 has the second welding surface 1321, and the second welding surface 1321 is fixed to the second isolation portion 23 of the another adjacent second plate 2 located at the another side of the first plate 1 by welding, so that the second isolation portion 23 separates the second inter-plate passage into the third inter-plate sub-passage and the fourth inter-plate sub-passage, in this way, the matching requirements of the isolation portions can be lowered, which facilitates mounting and processing.

Figure 2:
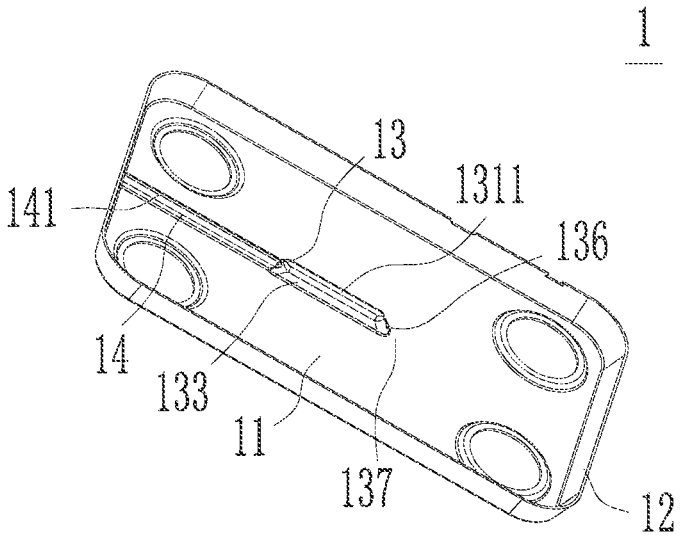
FIG. 2 is a schematic view showing the structure of a first plate of the heat exchanger according to the embodiment of the present application.
Figure 3:
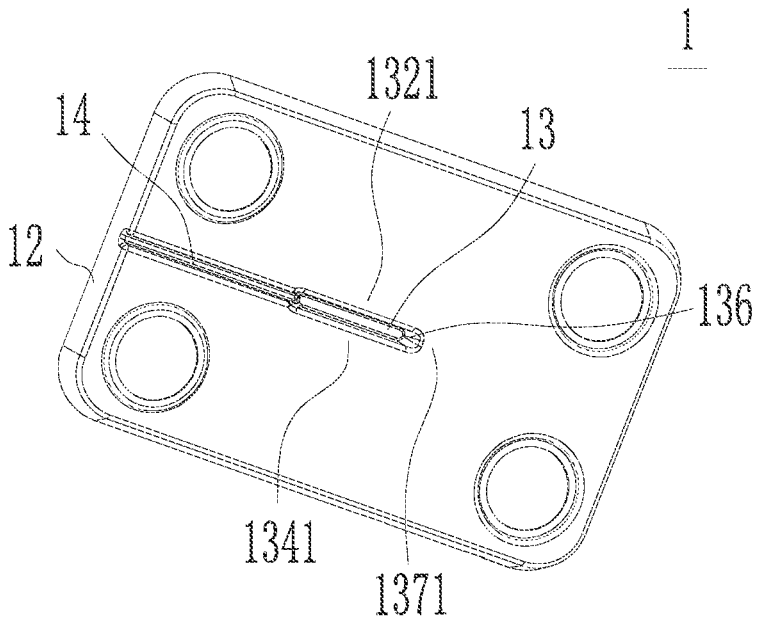
FIG. 3 is a schematic view showing another structure of the first plate of the heat exchanger according to the embodiment of the present application.

Referring to FIG. 2, FIG. 3 and FIG. 6, the first welding portion 13 protrudes from the middle portion along a stacking direction of the core 10. The first welding portion 13 has a fourth welding portion 134 and a fourth main body portion 135, and the fourth main body portion 135 is located between the first welding portion 131 and the fourth welding portion 134. The fourth main body portion 135 and a second main body portion 232 are at least partially opposite to each other, the second main body portion 232 is inclined with respect to the first middle portion 11, the fourth main body portion 135 is inclined with respect to the first middle portion 11, and an inclining direction of the second main body portion 232 with respect to the first middle portion 11 and an inclining direction of the fourth main body portion 135 with respect to the first middle portion 11 are opposite, that is, the second main body portion 232 and the fourth main body portion 135 are substantially in an inverted V-shape, which facilitates molding.

Referring to FIG. 2, FIG. 3 and FIG. 6, the first isolation portion 13 has a fifth main body portion 136 and a fifth welding portion 137, the fifth main body portion 136 is located between the second main body portion 232 and the fourth main body portion 135, the fifth main body portion 136 is located between the first welding portion 131 and the fifth welding portion 137, and the fifth welding portion 137 is located between the second welding portion 132 and the fourth welding portion 134. The fifth main body portion 136 is substantially U-shaped, in a width direction of the first plate 1, the second main body portion 232 and the fourth main body portion 135 are located at two sides of an opening of the U-shaped fifth main body portion 136, and the second main body portion 232 and the fourth main body portion 135 extend along a length direction of the first plate 1.

Referring to FIG. 2, FIG. 3 and FIG. 6, the second welding portion 132, the fourth welding portion 134 and the fifth welding portion 137 are coplanar with the first middle portion, that is, an upper surface of the second welding portion 132, an upper surface of the fourth welding portion 134 and an upper surface of the fifth welding portion 137 are in a same plane with an upper surface of the first middle portion 11; and a lower surface of the second welding portion 132, a lower surface of the fourth welding portion 134 and a lower surface of the fifth welding portion 137 are in a same plane with a lower surface of the first middle portion 11. The fifth welding portion 137 is substantially U-shaped, in the width direction of the first plate 1, the second welding portion 132 and the fourth welding portion 134 are located at two sides of the U-shaped fifth welding portion 137, and the second welding portion 132 and the fourth welding portion 134 extend along the length direction of the first plate 1, which facilitates molding and saves costs.

Figure 4:
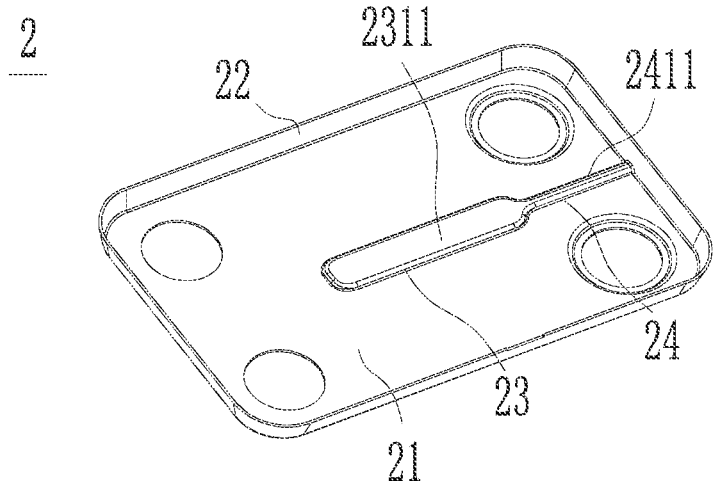
FIG. 4 is a schematic view showing the structure of a second plate of the heat exchanger according to the embodiment of the present application.
Figure 5:
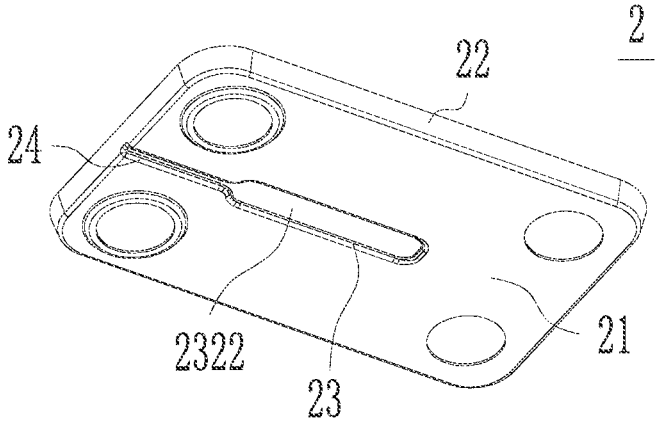
FIG. 5 is a schematic view showing another structure of the second plate of the heat exchanger according to the embodiment of the present application.

Referring to FIG. 4 to FIG. 6, the second plate 2 includes the second middle portion 21, and the second isolation portion 23 is located on the second plate 2. The second isolation portion 23 has a third welding portion 231, the second main body portion 232 and a third main body portion 233. Along the stacking direction of the core 10, the third welding portion 231 protrudes from the second middle portion 21, and the second main body portion 232 and the third main body portion 233 are located at two sides of the third welding portion 231, and the second main body portion 232 and the third main body portion 233 are at least partially opposite to each other.

Referring to FIG. 1 to FIG. 6, the fourth welding portion 134 has a fourth welding surface 1341, the fourth welding surface 1341 faces the adjacent second plate 2 located at the another side of the first plate 1. The third welding portion 231 has a third welding surface 2311, the third welding surface 2311 faces the adjacent first plate 1 located at one side of the second plate 2, the second welding surface 1321 is fixed to the third welding surface 2311 by welding, and the fourth welding surface 1341 is fixed to the third welding surface 2311 by welding. The fifth welding portion 137 has a sixth welding surface 1371, the sixth welding surface 1371 faces the adjacent second plate 2 located at the another side of the first plate 1, and the sixth welding surface 1371 is fixed to the third welding surface 2311 by welding. The third welding portion 231 has a fifth welding surface 2322, the fifth welding surface 2322 faces the adjacent first plate located at another side of the second plate, and the fifth welding surface 2322 is fixed to the first welding surface 1311 by welding, which reduces the stamping depth of the first isolation portion 13 and/or the second isolation portion 23, reduces the thickness reduction rate of the plates, thereby improving the corrosion resistance of the plates.

The first plate 1 further includes a fourth isolation portion 14, the fourth isolation portion 14 protrudes from the first middle portion 11; one end, away from the first isolation portion 13, of the fourth isolation portion 14 is connected with the first flange 12, and one end, away from the fourth isolation portion 14, of the first isolation portion 13 is not connected with the first flange 12. A top wall of the fourth isolation portion 14 forms a seventh welding portion, the seventh welding portion has an eighth welding surface 141, the eighth welding surface 141 faces the adjacent second plate 2 located at the one side of the first plate 1, and the eighth welding surface 141 is fixed to the adjacent second plate 2 located at the one side of the first plate 1 by welding. In the length direction of the first plate 1, a gap is provided between the end, away from the first isolation portion 13, of the fourth isolation portion 14 and the first flange 12, so as to allow the fluid to flow from the first inter-plate sub-passage to the second inter-plate sub-passage.

The second plate 2 further includes a third isolation portion 24, and the third isolation portion 24 protrudes from the second middle portion 21 along the stacking direction of the core 10. A top wall of the third isolation portion 24 forms a sixth welding portion, the sixth welding portion has a seventh welding surface 2411, the seventh welding surface 2411 faces the adjacent first plate 1 located at the one side of the second plate 2, and the seventh welding surface 2411 is fixed to the adjacent first plate 1 located at the one side of the second plate 2 by welding. One end of the third isolation portion 24 is connected with the second flange 22, and another end of the third isolation portion 24 is connected with the second isolation portion 23.

Figure 7:
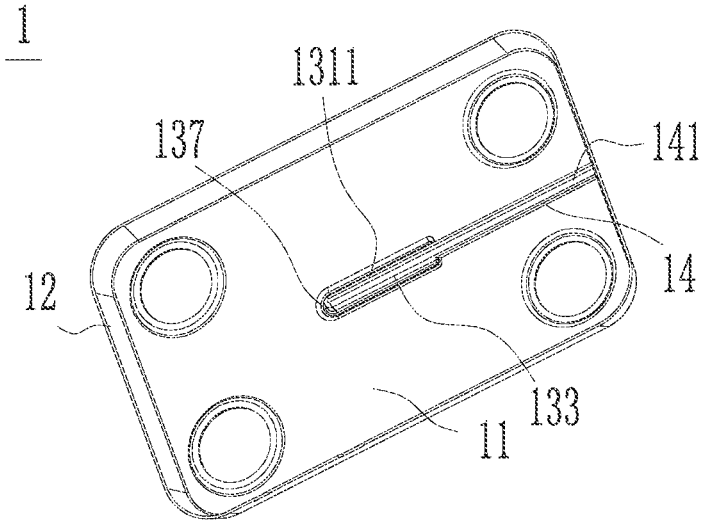
FIG. 7 is a schematic view showing the structure of a first plate of a heat exchanger according to another embodiment of the present application.
Figure 8:
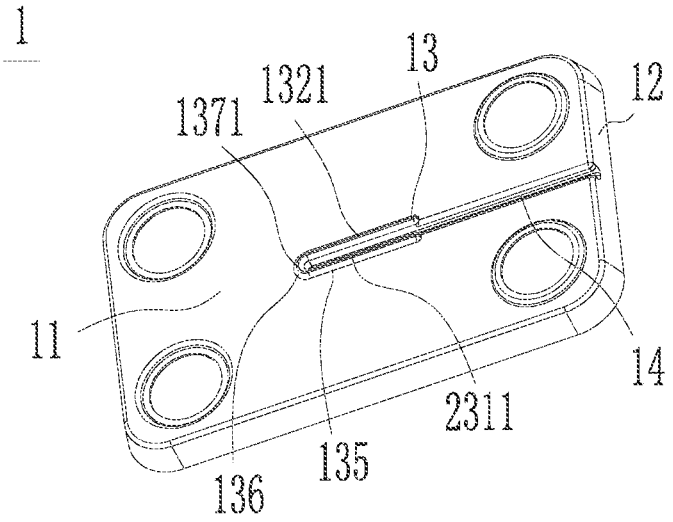
FIG. 8 is a schematic view showing another structure of the first plate of the heat exchanger according to the another embodiment of the present application.
Figure 9:
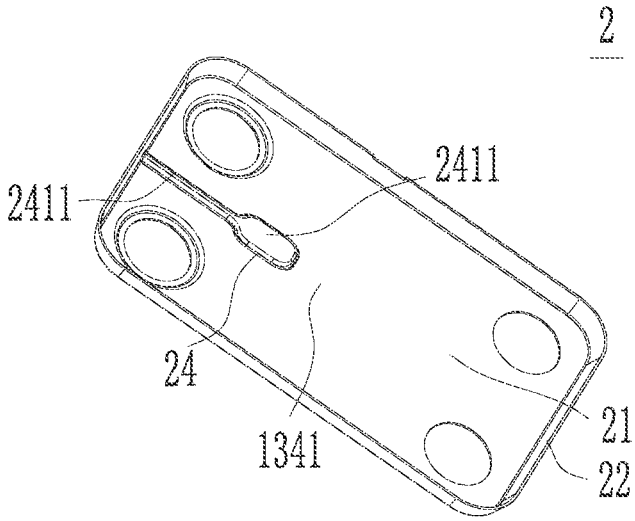
FIG. 9 is a schematic view showing the structure of a second plate of a heat exchanger according to the another embodiment of the present application.
Figure 10:
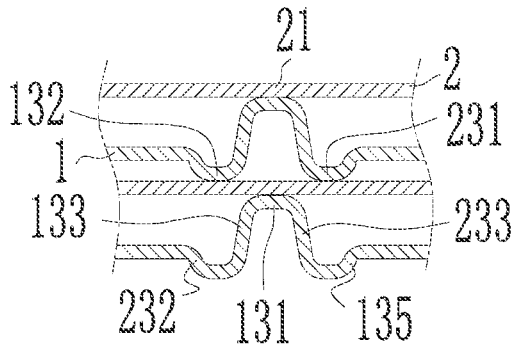
FIG. 10 is a partially cross-sectional schematic view of the heat exchanger according to the another embodiment of the present application.
Figure 11:
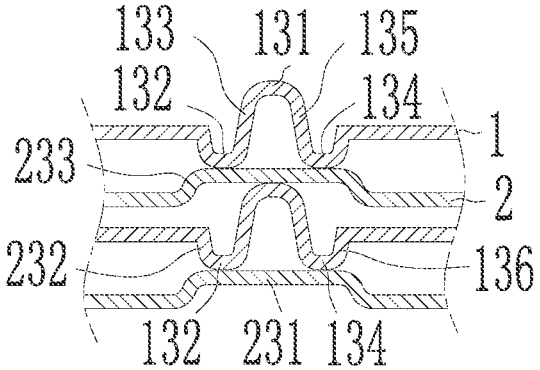
FIG. 11 is partially top view of a heat exchanger according to yet another embodiment of the present application.

Referring to FIG. 7, FIG. 8 and FIG. 10, the second welding portion 132 protrudes from the first middle portion 11 along a direction opposite to the stacking direction of the core 10, the second welding portion 23 has the second welding portion 132 and a second main body portion 232, and the second main body portion 232 is located between the first middle portion and the second welding portion 132.

Referring to FIG. 7, FIG. 8 and FIG. 10, the first isolation portion 13 has a third main body portion 233 and a third welding portion 231, the third main body portion 233 is located between the first welding portion 131 and the third welding portion 231, the third main body portion 233 and the first main body portion 133 are located at two sides of the first welding portion 131, and the third main body portion 233 and the first main body portion 133 are at least partially opposite to each other. The third welding portion 231 protrudes from the first middle portion along the direction opposite to the stacking direction of the core. The second isolation portion 23 has the third welding portion 231 and a fourth main body portion 135, and the fourth main body portion 135 is located between the third welding portion 231 and the first middle portion.

Referring to FIG. 7, FIG. 8 and FIG. 10, the first isolation portion 13 has a fifth main body portion 136 and a fifth welding portion 137, the fifth main body portion 136 is located between the first main body portion 133 and the third main body portion 233, and the fifth main body portion 136 is located between the first welding portion 131 and the fifth welding portion 137. The fifth welding portion 137 protrudes from the first middle portion 11 along the direction opposite to the stacking direction of the core. The second isolation portion 23 has the fifth welding portion 137 and a sixth main body portion, and the sixth main body portion is located between the fifth welding portion 137 and the first middle portion. The sixth main body portion is substantially U-shaped. The second main body portion 232 and the fourth main body portion 135 are located at two sides of an opening of the U-shaped sixth main body portion along the width direction of the first plate 1, and the second main body portion 232 and the fourth main body portion 135 extend along the length direction of the first plate 1.

Referring to FIG. 7 to FIG. 10, the first middle portion 11 has a fourth welding surface 1341 and a fifth welding surface, the fourth welding surface 1341 faces an adjacent first plate 1 located at one side of the second plate 2, and the fifth welding surface faces another adjacent first plate 1 located at another side of the second plate 2. The second welding surface 1321 is fixed to the fourth welding surface 1341 by welding. The third welding portion 231 has a third welding surface 2311, the third welding surface 2311 faces an adjacent second plate 2 located at one side of the first plate 1, and the third welding surface 2311 is fixed to the fourth welding surface 1341 by welding. The fifth welding portion 137 has a sixth welding surface 1371, the sixth welding surface 1371 faces the adjacent second plate 2 located at the another side of the first plate 1, and the sixth welding surface 1371 is fixed to the fourth welding surface 1341 by welding.

The second plate 2 includes a second flange 22 located at a periphery of the second middle portion 22. The second plate 2 further includes a third isolation portion 24, and the third isolation portion 24 protrudes from the second middle portion 21 along the stacking direction of the core 10. A top wall of the third isolation portion 24 forms the sixth welding portion, the sixth welding portion has a seventh welding surface 2411, the seventh welding surface 2411 faces the adjacent first plate located at one side of the second plate 2, and the seventh welding surface 2411 is fixed to the adjacent first plate 1 located at the one side of the second plate 2 by welding. One end of the third isolation portion 24 is connected with the second flange 22, and another end of the third isolation portion 24 is connected with the fifth main body portion 136, so that the heat exchanger has a much compact structure.

The first plate 1 includes a first middle portion 11, the first welding portion 131 protrudes from the first middle portion 11 along the stacking direction of the core 10, and the second welding portion 132 protrudes from the first middle portion 11 along the direction opposite to the stacking direction of the core 10. The first isolation portion 13 includes a second main body portion 232, and the second main body portion 232 is located between the first middle portion 11 and the second welding portion 132.

The second plate 2 includes a third welding portion 231 and a third main body portion 233, the second plate 2 includes a second middle portion 21, the third welding portion 231 protrudes from the second middle portion 21 along the stacking direction of the core 10, and the third main body portion 233 is located between the second middle portion 21 and the third welding portion 231. The third welding portion 231 has a third welding surface 2311, the third welding surface 2311 faces the adjacent first plate 1 located at one side of the second plate 2, and the second welding surface 1321 is fixed to the third welding surface 2311 by welding. The second isolation portion 23 includes the second welding portion 132, the second main body portion 232, the third welding portion 231 and the fourth main body portion 135.

The first isolation portion 13 has a fourth main body portion 135 and a fourth welding portion 134, the fourth welding portion 134 protrudes from the first middle portion 11 along the direction opposite to the stacking direction of the core 10, the fourth main body portion 135 is located between the first middle portion 11 and the fourth welding portion 134, the fourth main body portion 135 and the first main body portion 133 are located at two sides of the first welding portion 131, and the fourth main body portion 135 and the first main body portion 133 are substantially opposite to each other. The fourth welding portion 134 has a fourth welding surface 1341, the fourth welding surface 1341 faces the adjacent second plate 2 located at the another side of the first plate 1, and the fourth welding surface 1341 is welded to the third welding surface 2311. The first isolation portion 13 has a fifth main body portion 136, and the fifth main body portion 136 is located between the first middle portion 11 and the fourth welding portion 134.

The principle and the embodiments of the present application are illustrated herein by using specific examples. The above description of the embodiments is only intended to help the understanding of the idea of the present application. It should be noted that, for the person skilled in the art, many modifications and improvements may be made to the present application without departing from the principle of the present application, and these modifications and improvements are also deemed to fall into the protection scope of the present application defined by the claims.

The invention claimed is:

1. A heat exchanger, comprising a core, the core comprising first plates and second plates being stacked, and the core being provided with a first fluid passage and a second fluid passage isolated from each other; wherein the core is provided with first isolation portions and second isolation portions, each of the first isolation portions is located on a corresponding first plate of the first plates, and each of the second isolation portions is located on a corresponding second plate of the second plates;

the first isolation portion has a first welding portion, a second welding portion and a first main body portion, along a stacking direction of the core, the first main body portion is located between the first welding portion and the second welding portion; the first welding portion has a first welding surface, the first welding surface faces a second plate, located at one side of the first plate, of the second plates, and the first welding surface is fixed to the second isolation portion of the second plate located at the one side of the first plate by welding; the second welding portion has a second welding surface, the second welding surface faces another second plate, located at another side of the first plate, of the second plates, and the second welding surface is fixed to the second isolation portion of the another second plate located at the another side of the first plate by welding; wherein each of the second plates comprises a second middle portion, the second isolation portion has a third welding portion and a second main body portion; the third welding portion protrudes from the second middle portion along the stacking direction of the core; the third welding portion has a third welding surface, the third welding surface faces a corresponding first plate located at one side of the second plate, and the second welding surface is fixed to the third welding surface by welding; and the second isolation portion has a third main body portion, the second main body portion and the third main body portion are located at two sides of the third welding portion, the second main body portion and the third main body portion are at least partially opposite to each other, the first isolation portion has a fourth welding portion and a fourth main body portion, the fourth main body portion is located between the first welding portion and the fourth welding portion, the fourth main body portion and the second main body portion are at least partially opposite to each other, the fourth welding portion has a fourth welding surface, the fourth welding surface faces the adjacent second plate located at the one side of the first plate, and the fourth welding surface is fixed to the third welding surface by welding; and wherein the first welding portion has a fifth main body portion and a fifth welding portion, the fifth main body portion is located between the second main body portion and the fourth main body portion, the fifth main body portion is located between the first welding portion and the fifth welding portion, the second welding portion, the fourth welding portion and the fifth welding portion are coplanar with the first middle portion, and the fifth welding portion is located between the second welding portion and the fourth welding portion; the fifth welding portion has a sixth welding surface, the sixth welding surface faces the adjacent second plate located at the one side of the first plate, and the sixth welding surface is fixed to the third welding surface by welding.

2. The heat exchanger according to claim 1, wherein each of the first plates comprises a first middle portion, the first welding portion protrudes from the first middle portion along the stacking direction of the core, the second welding portion protrudes from the first middle portion along a direction opposite to the stacking direction of the core, the second welding portion is located at the corresponding first plate, and the second main body portion is located between the first middle portion and the second welding portion.

3. The heat exchanger according to claim 2, wherein the third main body portion is located between the first welding portion and the third welding portion, the third main body portion and the first main body portion are located at two sides of the first welding portion, the third main body portion and the first main body portion are at least partially opposite to each other, the third welding portion protrudes from the first middle portion along the direction opposite to the stacking direction of the core, the third welding surface faces the adjacent second plate located at the another side of the first plate, and the third welding surface is fixed to the adjacent second plate located at the another side of the first plate by welding;

and the fourth main body portion is located between the third welding portion and the first middle portion.

4. The heat exchanger according to claim 3, wherein the first isolation portion is provided with a fifth main body portion and a fifth welding portion, the fifth main body portion is located between the first main body portion and the third main body portion, the fifth main body portion is located between the first welding portion and the fifth welding portion, the fifth welding portion protrudes from the first middle portion along the direction opposite to the stacking direction of the core, the fifth welding portion has a sixth welding surface, the sixth welding surface faces the adjacent second plate located at the another side of the first plate, and the sixth welding surface is fixed to the adjacent second plate located at the another side of the first plate by welding.

5. The heat exchanger according to claim 4, wherein the second plate comprises a second flange located at a periphery of the second middle portion, the second plate comprises a third isolation portion, the third isolation portion protrudes from the second middle portion along the stacking direction of the core, a top wall of the third isolation portion forms a sixth welding portion, the sixth welding portion has a seventh welding surface, the seventh welding surface faces the adjacent first plate located at one side of the second plate, and the seventh welding surface is fixed to the adjacent first plate located at the one side of the second plate by welding; one end of the third isolation portion is connected with the second flange, and another end of the third isolation portion is connected with the fifth main body portion.

6. The heat exchanger according to claim 1, wherein the first plate comprises a first middle portion, the first welding portion protrudes from the first middle portion along the stacking direction of the core, the second welding portion protrudes from the first middle portion along a direction opposite to the stacking direction of the core, and the second main body portion is located between the first middle portion and the second welding portion.

7. The heat exchanger according to claim 6, wherein the fourth welding portion protrudes from the first middle portion along the direction opposite to the stacking direction of the core, the fourth main body portion is located between the first middle portion and the fourth welding portion, the fourth main body portion and the first main body portion are located at two sides of the first welding portion respectively, the fourth main body portion and the first main body portion are at least partially opposite to each other; the first isolation portion has a fifth main body portion, and the fifth main body portion is located between the first middle portion and the fourth welding portion.

* * * * *